US006622357B2

(12) United States Patent
Jackson et al.

(10) Patent No.: US 6,622,357 B2
(45) Date of Patent: Sep. 23, 2003

(54) CONTINUAL COMFORT ADJUSTING FASTENER FOR A FOOTWEAR ARTICLE

(75) Inventors: Robert Jackson, 17717 Vail St. #1312, Dallas, TX (US) 75287; Troy Robinson, 10903 Dove Creek Cir., Houston, TX (US) 77086

(73) Assignees: Robert Jackson, Irving, TX (US); Troy Robinson, Houston, TX (US)

( * ) Notice: Subject to any disclaimer, the term of this patent is extended or adjusted under 35 U.S.C. 154(b) by 0 days.

(21) Appl. No.: 09/939,461

(22) Filed: Aug. 25, 2001

(65) Prior Publication Data

US 2002/0194712 A1 Dec. 26, 2002

Related U.S. Application Data

(60) Provisional application No. 60/300,311, filed on Jun. 22, 2001.

(51) Int. Cl.[7] ..... A43C 1/00; A44B 13/00; A44B 21/00

(52) U.S. Cl. ..... 24/712; 24/712.1; 24/713.6; 24/715.3; 24/300

(58) Field of Search ..... 24/300, 715.3, 24/712, 712.1, 712.7, 712.8, 713.6, 714.1, 714.2, 714.8, 714.9

(56) References Cited

U.S. PATENT DOCUMENTS

| | | | | | |
|---|---|---|---|---|---|
| 744,729 | A | | 11/1903 | Driscoll | |
| 820,420 | A | * | 5/1906 | Hodson | 24/712.1 |
| 853,638 | A | * | 5/1907 | Heisdorf | 24/215.3 |
| 872,221 | A | * | 11/1907 | Bright | 24/300 |
| 1,168,771 | A | * | 1/1916 | Weatherley | 24/715.3 |
| 1,470,259 | A | * | 10/1923 | Ehrman | 24/300 |
| 1,578,817 | A | * | 3/1926 | Fischer | 24/300 |
| 1,781,708 | A | * | 11/1930 | Sheldrake | 24/300 |
| 2,575,226 | A | * | 11/1951 | McHarry | 24/715.3 |
| 3,221,384 | A | * | 12/1965 | Aufenacker | 24/712.1 |
| 4,088,311 | A | * | 5/1978 | Rupprecht | 267/74 |
| 4,296,515 | A | | 10/1981 | Hauser | |
| D327,568 | S | | 7/1992 | Dutkanych | |
| 5,203,053 | A | * | 4/1993 | Rudd | 24/712 |
| 5,230,171 | A | | 7/1993 | Cardaropoli | |
| 5,465,442 | A | | 11/1995 | Merser | |
| 5,530,991 | A | * | 7/1996 | DeNormand et al. | 16/198 |
| D380,890 | S | | 7/1997 | Donnel | |
| 5,737,811 | A | | 4/1998 | Rashid | |
| 6,014,794 | A | * | 1/2000 | Mc Coy | 24/300 |

* cited by examiner

*Primary Examiner*—Victor Sakran
(74) *Attorney, Agent, or Firm*—Baker Botts L.L.P.

(57) ABSTRACT

The present invention relates to a continual comfort adjusting fastener for a footwear article and provides an alternative to fasteners that necessitate periodic attention by the wearer in order to maintain a proper combination of support, fit and comfort by utilizing spring mechanisms to induce a predetermined amount of tension between opposing eye flaps of the footwear article. In accordance with various exemplary embodiments of the present invention, the spring mechanism portion of the spring assembly that provides constant tension between eye flaps may be one of a tension spring, compression spring and torsion spring. The spring assembly is comprised substantially of a spring mechanism and may be fastened directly to eyelets in the footwear article. In accordance with other exemplary embodiments, the spring assembly is further comprised of locking eyelets which themselves are attached to the eye flap of the footwear article via rivets, thus replacing the eyelets. With respect to embodiments that make use of eyelets in the footwear eye flap, the attachment means for the spring mechanism is a simple "J" hook and thereby may be hooked into existing eyelets, alternatively the J hook attachment might be fastened to the aforementioned locking eyelets. The J hook attachment is open ended, thereby allowing the spring mechanism to be easily disconnected from the corresponding eyelet at any time for ease of entry into the footwear article and further, the J hook attachment configuration is compatible with all types of spring mechanisms.

19 Claims, 6 Drawing Sheets

616
602

602
616
604
612

602
610
604
612

CONTINUAL COMFORT ADJUSTING FASTENER FOR A FOOTWEAR ARTICLE

CROSS REFERENCES TO RELATED APPLICATIONS

The present U.S. patent application with priority based on the following co-pending U.S. patent application:

U.S. provisional patent application entitled, "CONTINUAL COMFORT ADJUSTING FASTENER FOR A FOOTWEAR ARTICLE", having application No. 60/300,311 and filed on Jun. 22, 2001, currently pending;

which has identical inventive entity as the present invention and is incorporated by reference in its entirety.

BACKGROUND OF THE INVENTION

1. Field of the Invention

The present invention relates generally to the field of footwear, and more particularly to an improved footwear article for applying a predetermined amount of support to the wearer which continually adjusts to changes in the wearer's foot without manual intervention.

2. Description of Related Art

Throughout history, footwear has been sought after that provide protection and support for a wearer's foot, while at the same time is comfortable and simple to wear and secure. Currently, a popular fastening means for securing footwear to the wearer's foot is by using a shoelace and eyelet combination, wherein a lace is threaded through eyelets that are positioned on a footwear article so as to lie either side of a shoe tongue and along opposing eyelet flaps. The laces are first laced through the eyelets in a crossway pattern, alternating from one eyelet flap to the other and then back again. After lacing, the footwear article is normally tightened comfortably to provide support and then the laces are tied. While this is an adequate method of securing footwear, when one string breaks a new one is needed. Moreover, the laces must be periodically loosened and tightened to maintain the desired support while remaining comfortable.

Footwear comes in a variety of styles including low-quarter, mid-quarter, high-quarter, high-top and boot. Generally, the higher the footwear article fits on the wearer's ankle, the more support afforded to the wearer by the article. Thus, persons desiring more support naturally gravitate toward mid-quarter, high-quarter, high-top and boot type footwear. Also, as the height of the footwear article increase, so does the amount of fasteners needed to secure the article on the wearer's foot. It then follows that persons needing more foot support must devote a significant amount of time for securing the article with the accompanying fastening means.

A particular problem inherent with prior art fasteners is that they need periodic attention in order to maintain the support, fit and comfort to the wearer. As the day progresses, a wearer's foot goes through successive stages of swelling and contraction which necessitate adjusting footwear for support and comfort. As the human foot becomes uncomfortable, overheated or stressed from long periods of standing or walking, the capillaries carrying blood to and from the feet become constricted and the blood flow to the foot is diminished, usually due to the retention of fluid. With the diminished blood flow, the foot retains even more fluid causing the capillaries to constrict even further until the source of the discomfort is alleviated. Normally, the best cure for foot swelling is the removal of the offending footwear, followed by elevating the wearer's feet. However, in the normal rigger of an everyday life it is virtually impossible to take a time-out for pediatric care, much less elevating ones bare feet for a period of time. Thus, those who suffer from foot discomfort are left with the alternative of loosening the footwear fasteners at the onset of discomfort and then, once the period of discomfort abates, re-securing the fasteners to provide the necessary support.

As it happens however, persons with a particular need for foot support are often the same persons who experience extreme bouts of foot swelling necessitating continual adjustments to the footwear fasteners. In a cruel twist, these persons are also likely to experience difficulties with footwear fasteners. For example, a pregnant woman may require the added support provided by a mid-quarter, high-quarter or high-top shoe due to the increased weight resulting from the pregnancy. Foot swelling that often accompanies a pregnancy causes the pregnant woman additional foot discomfort that is only remedied by intermittently loosening and then re-securing as the footwear fasteners corresponding with the alternating periods of foot swelling and foot contracting passes, and then re-securing. A pregnant woman's condition further exacerbates maintaining the proper mix of footwear support, fit and comfort because of the difficulty in stooping and bending necessary for adjusting the fasteners brought about by the pregnancy. Thus, a pregnant woman is often left with the choices of risking foot and ankle injury from footwear that is comfortable but does not provide any meaningful support, and being tormented with the incessant bending necessary to keep fasteners on supportive footwear adjusted to the continual cycles of foot swelling and foot contracting. Often a pregnant woman will opt for the most convenient footwear and disregard the danger of foot and ankle injury, all too frequently resulting in tragic consequences.

The problem described above is typical of numerous diseases, conditions and ailments such as diabetes, osteoporosis (and other brittle bone syndromes) and obesity to mention a few. The prior art is silent on providing a fastener that maintains foot support, while simultaneously allowing of ease of adjustment. These fasteners are relegated to include zippers, straps with buckle, hook or snap fasteners, and hook and loop fasteners (Velcro, a trademark of Velcro Industries B. V.). Although these appliances often reduce the amount of time and effort necessary for adjusting footwear, over the lace and eyelet combination, the wearer must still be content with periodically adjusting the footwear article in an effort to maintain the optimal combination of support, fit and comfort.

BRIEF SUMMARY OF THE INVENTION

The present invention relates to a continual comfort adjusting fastener for a footwear article and provides an alternative to fasteners that necessitate periodic attention by the wearer in order to maintain a proper combination of support, fit and comfort by utilizing spring mechanisms to induce a predetermined amount of tension between opposing eye flaps of the footwear article. In contrast with prior art laces and straps, the spring mechanism provide needed support but also flexes in response to foot swelling, thus reducing or eliminating foot discomfort due to tightness about the foot. Moreover, because the spring mechanisms are independent of one another, the support offered by footwear incorporating the present invention can easily be tailored to an individual wearer's particular support requirement and may be varied along the extent of the foot. Footwear manufacturers benefit from the present invention due to the extremely developed nature of elastics and the ready supply of component springs, available in a wide variety of tensions, for production. The present invention bypasses the need to tie shoes, and with respect to one embodiment is similar to a low leather step-in shoe such as a loafer in that the spring assembly is never adjusted, even during putting on or taking off the footwear. Thus it is also easier for young children, disabled and infirm persons who can not tie their own shoes.

In accordance with various exemplary embodiments of the present invention, the spring mechanism portion of the spring assembly that provides constant tension between eye flaps may be one of a tension spring, compression spring and torsion spring. The spring assembly is comprised substantially the spring mechanism and thereby may be fastened directly to eyelets in the footwear article, or in accordance other exemplary embodiments, the spring assembly is further comprised of locking eyelets which themselves are attached to the eye flap of the footwear article via rivets, thus replacing the eyelets. With respect to embodiment that make use of eyelets in the footwear eye flap, the attachment means for the spring mechanism is a simple "J" hook and thereby may be hooked into existing eyelets, alternatively the J hook attachment might be fastened to the aforementioned locking eyelets. The J hook attachment is open ended, thereby allowing the spring mechanism to be easily disconnected from the corresponding eyelet at any time for ease of entry into the footwear article and further, the J hook attachment configuration is compatible with all types of spring mechanisms.

In accordance with another exemplary embodiment the spring attachment means is fashioned into a more closed loop configuration constituting a safety catch which cooperates with a locking eyelet, thus preventing accidental disconnects or the sharp wire ends from protruding into the shoe cavity, as might be possible in the case of the J hook. With respect to further improvements, the safety catch may be disposed internally within the spring coils of the tension spring mechanism and provide a semi-permanent connection or instead the locking eyelet may be connected to the first coil of a tension spring and the safety catch encompasses and secures the locking eyelet thereon, also semi-permanently.

The invention is also aesthetically pleasing since the spring mechanism, and in fact the spring assembly itself, can be metallically plated with shiny metals or painted in different colors which match or contrast the color of the footwear article.

BRIEF DESCRIPTION OF THE DRAWINGS

The novel features believed characteristic of the invention are set forth in the appended claims. The invention itself, however, as well as an exemplary mode of use, further objectives and advantages thereof, will best be understood by reference to the following detailed description of an illustrative embodiment when read in conjunction with the accompanying drawings, wherein:

The present invention is illustrated by way of example, and not by way of limitation, in the figures of the accompanying drawings and in which like reference numerals indicate similar elements and in which.

Other features of the present invention will be apparent from the accompanying drawings and from the detailed description which follows.

DETAILED DESCRIPTION OF THE INVENTION

Figure 1:
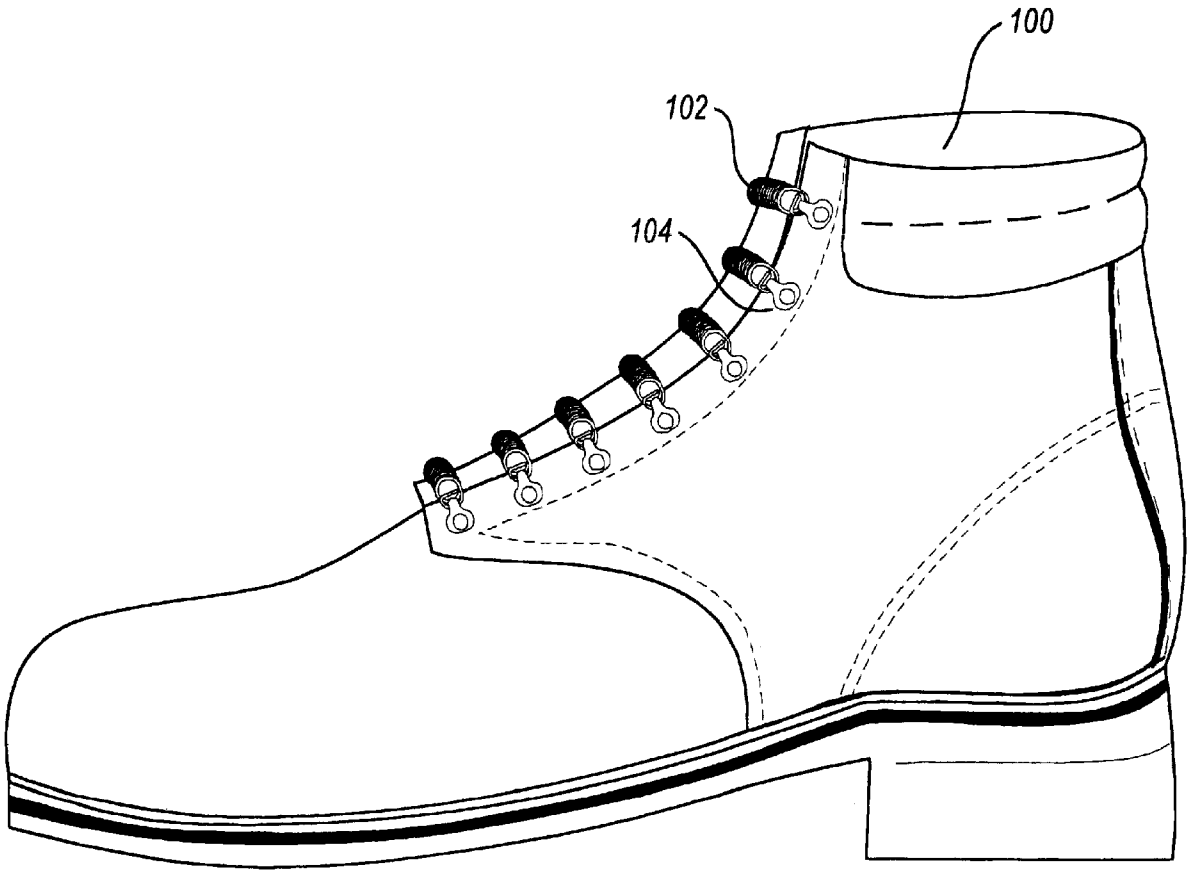
FIG. 1 is a side elevation of a footwear article incorporating a plurality of continual comfort adjusting fasteners in accordance with an exemplary embodiment of the present invention.

FIG. 1 is a side elevation of a footwear article incorporating a plurality of continual comfort adjusting fasteners in accordance with an exemplary embodiment of the present invention. In the Figure, footwear article 100 is illustrated as a high-quarter or high-top shoe and disposed thereon are seven continual comfort adjusting fasteners. However, it should be understood that the use of a particular footwear article is merely illustrative and in no way is intended to limit the present invention. Furthermore, the use of a particular type of spring mechanism, spring assembly or quantity of said mechanisms and assemblies is likewise merely a matter of convenience for describing the present invention to the reader and in no way limits the use or application of the present invention. The present invention may be incorporated on virtually any footwear article in any position on the article.

The present invention relates to a continual comfort adjusting fastener for a footwear article and provides an alternative to fasteners that necessitate periodic attention by the wearer in order to maintain a proper combination of support, fit and comfort by utilizing spring mechanisms to induce a predetermined amount of tension between opposing eye flaps of the footwear article. In contrast with prior art laces and straps, the spring mechanism provide needed support but also flexes in response to foot swelling, thus reducing or eliminating foot discomfort due to tightness about the foot. Moreover, because the spring mechanisms are independent of one another, the support offered by footwear incorporating the present invention can easily be tailored to an individual wearer's particular support requirement and may be varied along the extent of the foot. The spring mechanisms can, as can the spring assemblies, be tuned independently for the individual, size of the wearer's foot and footwear article size, number of eyelets or fasteners and shoe type to name a few. Spring tensions can be individually calculated for any application and with minimal investigation, spring tension algorithms can be developed for each application (shoe size, type, number of fasteners, distance between eye flaps, etc.). Footwear manufacturers benefit from the present invention due to the extremely developed nature of elastics and the ready supply of component springs, available in a wide variety of tensions, for production.

In illustrating the present invention, footwear article 100 has disposed thereon a plurality of spring assemblies, each of which comprising of spring mechanism 102 and a pair of locking eyelets 104 that are attached to the eye flap of footwear article 100 with rivets. Spring mechanism 102 may be any one of the spring mechanisms depicted in FIGS. 3A–D, 4A–C, 5A–B or 6A–C, however as can be seen from FIG. 1, spring mechanism 102 is a tension spring is of the type illustrated on FIGS. 3A and 3B.

Figure 3A:
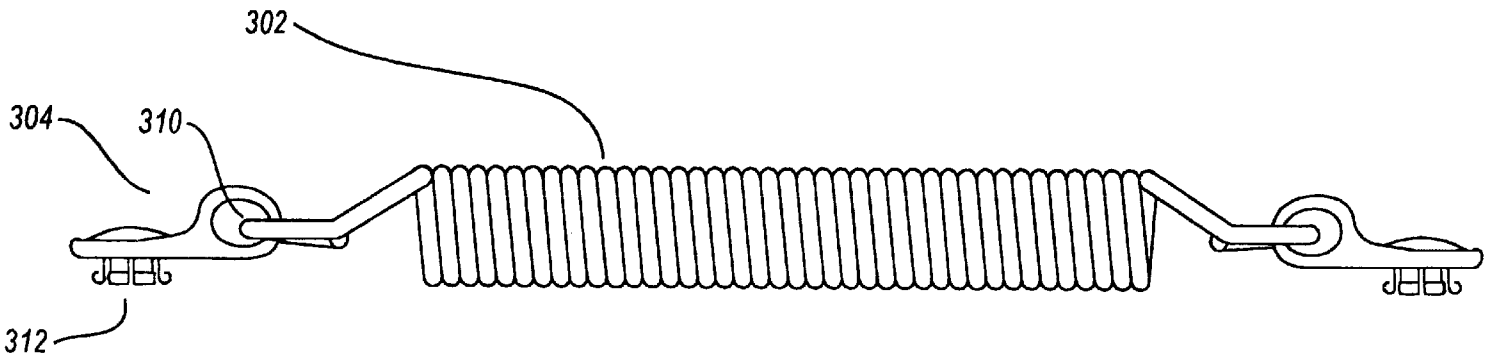
FIGS. 3A and 3B are side and top elevations of a tension spring assembly, respectively, in accordance with exemplary embodiments of the present invention.
Figure 3B:
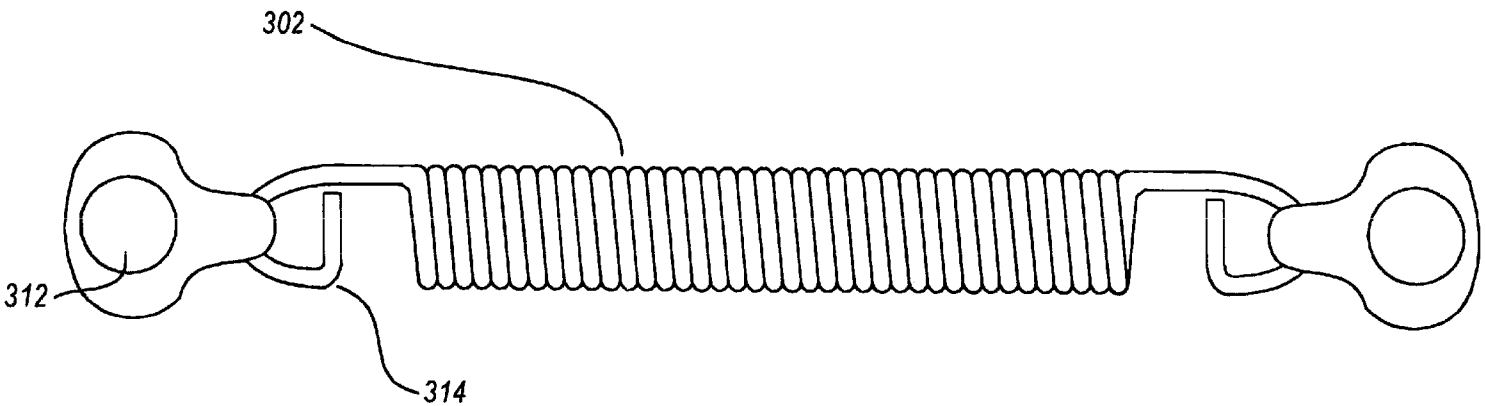

FIGS. 3A and 3B are side and top elevations of a tension spring assembly, respectively, in accordance with exemplary embodiments of the present invention. The spring assembly illustrated in the present exemplary embodiment comprises tension spring mechanism 302 and a pair of locking eyelets 304. Tension spring mechanism 302 is shown in its relaxed state and in such state, exerts no tension on locking eyelets 304. Locking eyelets 304 further comprise a main body with eyelet 310 near one extent and an aperture near the opposite extent (not shown), through which rivet 312 traverses for fastening locking eyelet 304 to an eye flap, for instance on footwear article 100 shown in FIG. 1. Returning to FIGS. 3A and 3B, tension spring mechanism 302 is connected to eyelet 310 of locking eyelets 304 by spring attachment means 314. In the present illustration, a tension spring connector or attachment means 314 is a substantially closed loop configuration constituting a safety catch which substantially encircles eyelet 310 on locking eyelet 304, thus reducing the likelihood of an accidental disconnection.

Figure 2B:
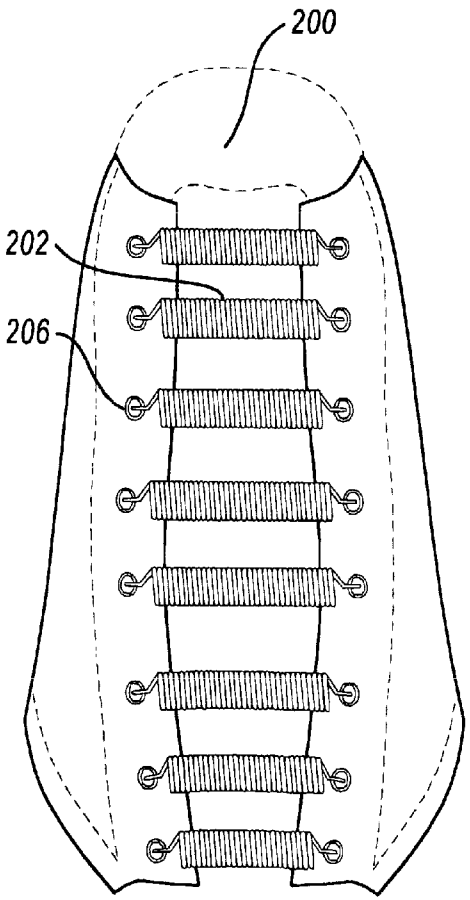
FIG. 2B depicts a plurality of tension spring mechanisms in a front elevation of the eye flap portions of a footwear article in accordance with an exemplary embodiment of the present invention.
Figure 2A:
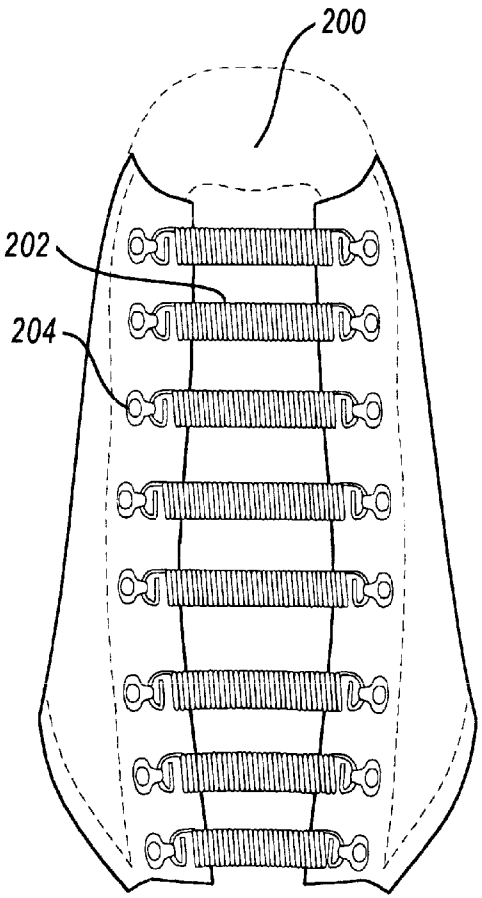
FIG. 2A depicts a plurality of tension spring mechanisms as a front elevation of the eye flap portion of a footwear article in accordance with an exemplary embodiment of the present invention.

Turning now to FIG. 2A, a plurality of tension spring mechanisms are depicted in a front elevation of the eye flap portion of a footwear article in accordance with an exemplary embodiment of the present invention. Notice that in the present depiction, tension spring mechanisms 202 are in their respective related state and in such state, exerts no tension on locking eyelets 204 or eye flaps 200. This is so because the tension provided by tension spring mechanisms 202 is meant to be exerted on the foot of the wearer and not on the footwear itself—when not in use. Thus, the amount of tension is dictated by the outward pressure exerted on eye flaps 200 when being forced open by a foot or the like. It can now be clearly understood that the amount of tension applied to a wearer's foot is approximately proportional to the amount of distance that eye flaps 200 are forced apart. It then follows that unlike prior art fasteners that exert force on the wearer's foot in a nonlinear fashion due to the inflexibility of the fastener itself, the spring mechanisms of the present invention exert a more linear increase in tension that is brought about by, for example, foot swelling. Moreover, because even significant foot swelling will cause eye flaps 200 to be forced apart by only minimal distances, the force increase on the wearer's foot is likewise minimal, many times imperceptible, while maintaining the fit and support needed by the wearer.

Figure 4A:
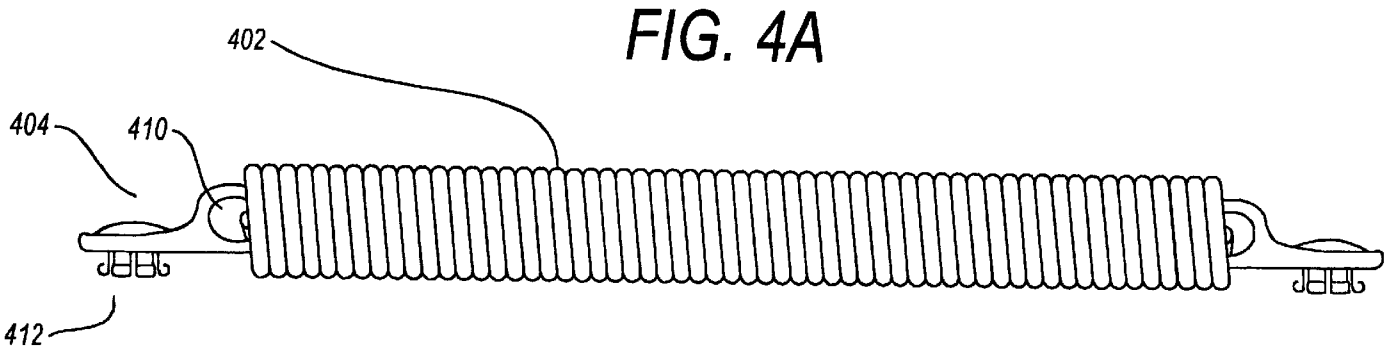
FIGS. 4A–4C depict a spring assembly including a tension spring mechanism with various spring attachment means in accordance with an exemplary embodiment of the present invention.
Figure 4B:
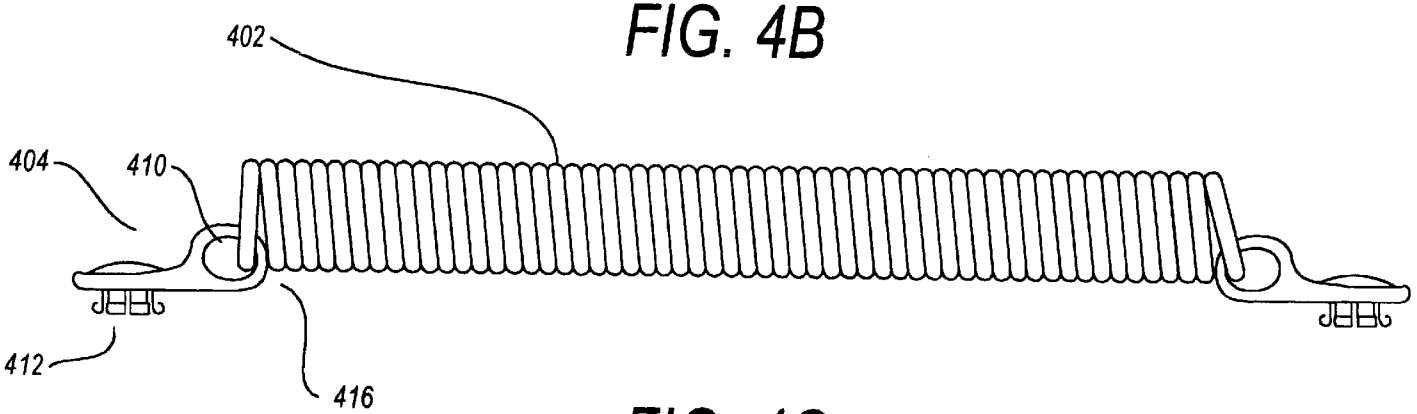
Figure 4C:
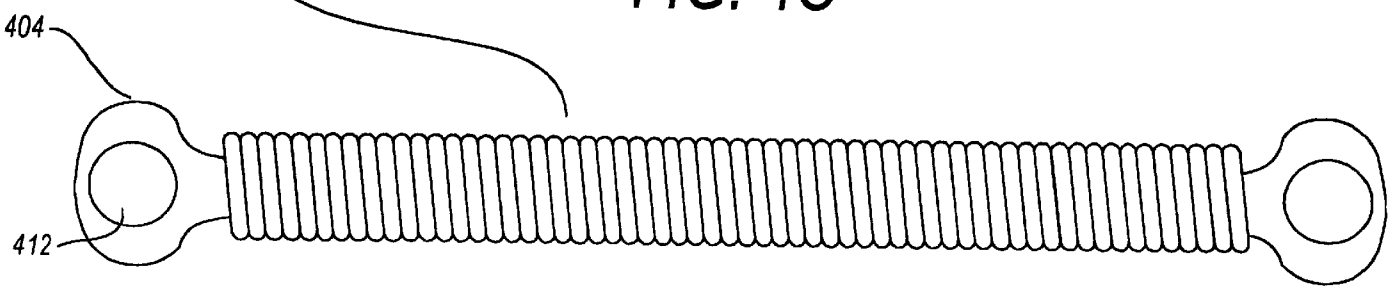

Turning now to FIGS. 4A–4C, a spring assembly is depicted including a tension spring mechanism and with various spring attachment means in accordance with an exemplary embodiment of the present invention. With respect to the Figures, FIG. 4A is a side elevation of a tension spring mechanism 402, depicting eyelets 410 of locking eyelets 404 partially inserted in the coils of tension spring mechanism 402, wherein a spring attachment means is fashioned from the outer extent of tension spring mechanism 402 and into a substantially more closed loop configuration constituting a safety catch (not shown). The safety catch may be disposed internally within the spring coils of tension spring mechanism 402 and thereby provides a semi-permanent connection which cooperates with eyelet 410 to prevent accidental disconnects. FIG. 4B illustrates a similar concept. There a side elevation of a tension spring mechanism 402 is shown with eyelets 410 of locking eyelets 404 encircling the lowermost extent of the first coil on tension spring mechanism 402. With respect to this exemplary embodiment, eyelets 404 are connected to the first coil of a tension spring and the safety catch (not shown) encompasses and secures tension spring mechanism 402 to locking eyelet 404 in a semi-permanent fashion, i.e. the wearer may remove tension spring mechanism 402 from locking eyelet 404 but with some difficulty. FIG. 4C illustrates a top elevation of a tension spring mechanism 402 shown in either FIG. 4A or 4B. It should be now understood that spring mechanism configurations depicted in FIGS. 4A–4C allow for utilizing more spring coils in an equivalent amount of space as that shown in FIGS. 3A and 3B due to the reduction to the length of the attachment means, thus less tensions for application where space is limited and the tension must remain lower.

Turning now to FIG. 2B, a plurality of tension spring mechanisms are depicted in a front elevation of the eye flap portions of a footwear article in accordance with an exemplary embodiment of the present invention. However, in contrast with the embodiment illustrated in FIG. 2A, shown to the right, here tension spring mechanisms 202 are configured with "J" hook spring attachment means and connected directly to existing eyelets 206 in eye flaps 200. The J hook is a substantially open ended spring attachment formed by shaping the outer extent of tension spring mechanisms 202 into a shape that is reminiscent of the letter "J." With respect to embodiment that make use of eyelets in the footwear eye flap, the attachment means for the spring mechanism is a simple "J" hook and thereby may be hooked into existing eyelets, alternatively the J hook attachment might be fastened to the aforementioned locking eyelets. The J hook spring attachment means allows spring mechanism 202 to be easily disconnected from a corresponding eyelet 206 at any time. This allows the wearer a convenient means to disconnect tension spring mechanisms 202 for putting on and taking off the footwear. It is anticipated that in most embodiments the wearer will easily be able to ingress and egress various types of footwear without disconnecting the spring mechanism. However, in some high-top footwear and boots the opening left for insertion of the wearer's foot is simply too small to accommodate a human foot, thus the J hook spring attachment means is a viable alternative. Moreover, even though the wearer must disconnect the J hook during entry, it will be appreciated that thereafter the continual comfort adjusting fasteners function as intended and the wearer need not disconnect the fastener for foot swelling or the like.

Figure 5A:
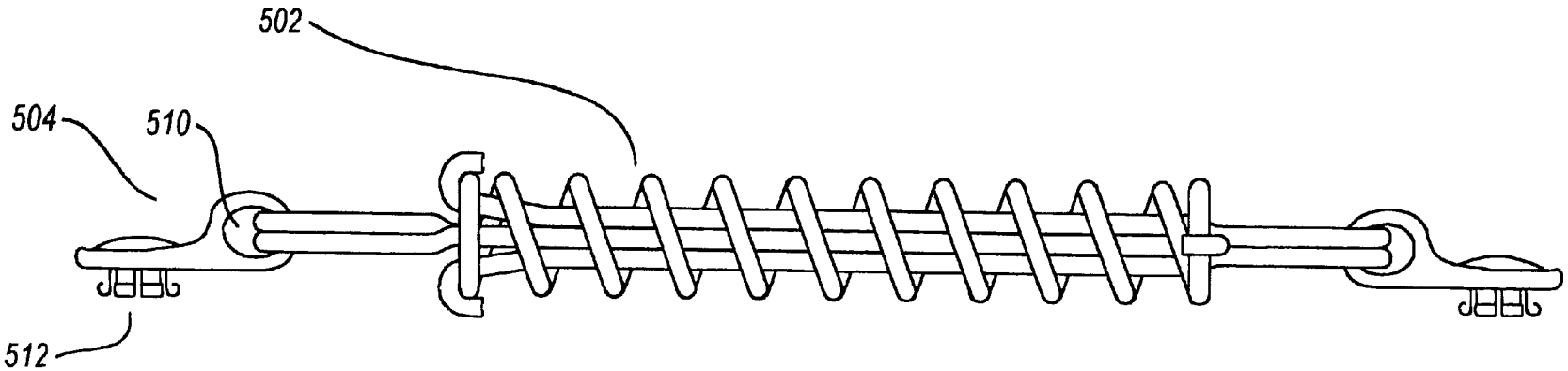
FIGS. 5A and 5B depict a spring assembly in side and top elevations, respectively, which comprises a compression type spring mechanism, in accordance with exemplary embodiments of the present invention.
Figure 5B:
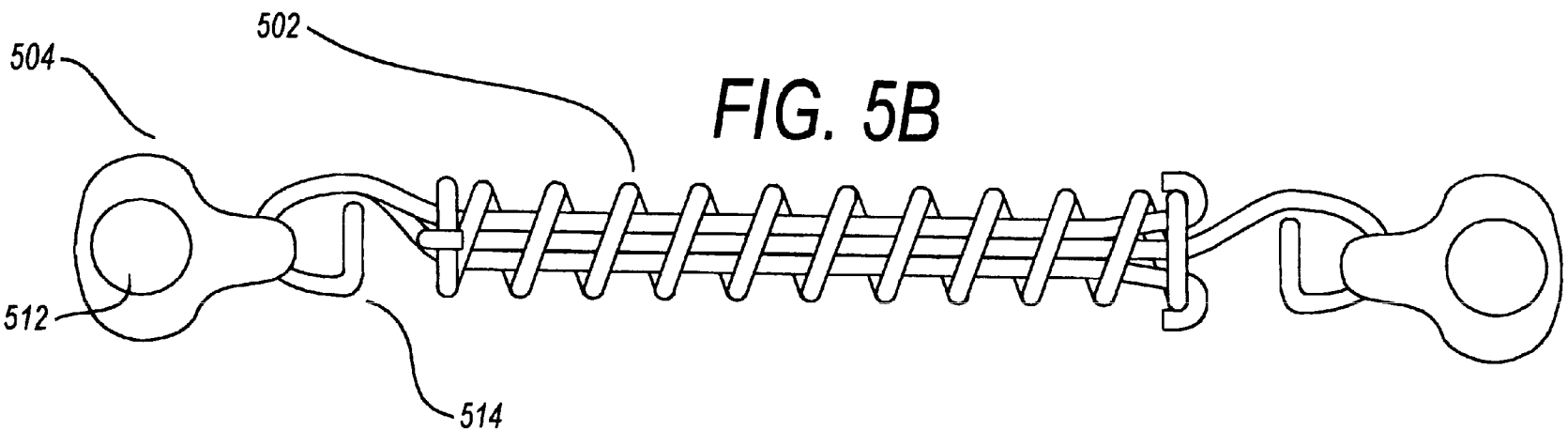

Turning now to FIGS. 5A and 5B, a spring assembly is depicted which comprises a compression type spring mechanism, in accordance with exemplary embodiments of the present invention. FIGS. 5A and 5B are side and top elevations of compression spring mechanism 502, respectively, and is connected to a pair of locking eyelets 504. Compression spring mechanism 502 is shown in its relaxed state and in such state, currently exerts no tension on locking eyelets 504. Similar to the other illustrations described above, locking eyelets 504 further comprise a main body with eyelet 510 near one extent and an aperture near the opposite extent (not shown), through which rivet 512 traverses for fastening locking eyelet 504 to an eye flap, for instance on footwear article 100 shown in FIG. 1. The depicted spring assembly is shown with a safety catch type of spring attachment means 514 but a J hook could also be substituted. However, due to the unique operating nature of compression spring mechanism 502, care must be taken when attempting to configure spring attachment means 514 with a safety catch disposed internally within the coils of compression spring mechanism 502, the workings of the spring may be interfered with. Additionally, because the coils of compression spring mechanism 502 move in the opposite direction as that of a tension type spring mechanism, it is not possible to connect eyelet 510 to the first coil as in a tension type spring mechanism.

Figures 6A, 6B, 6C:
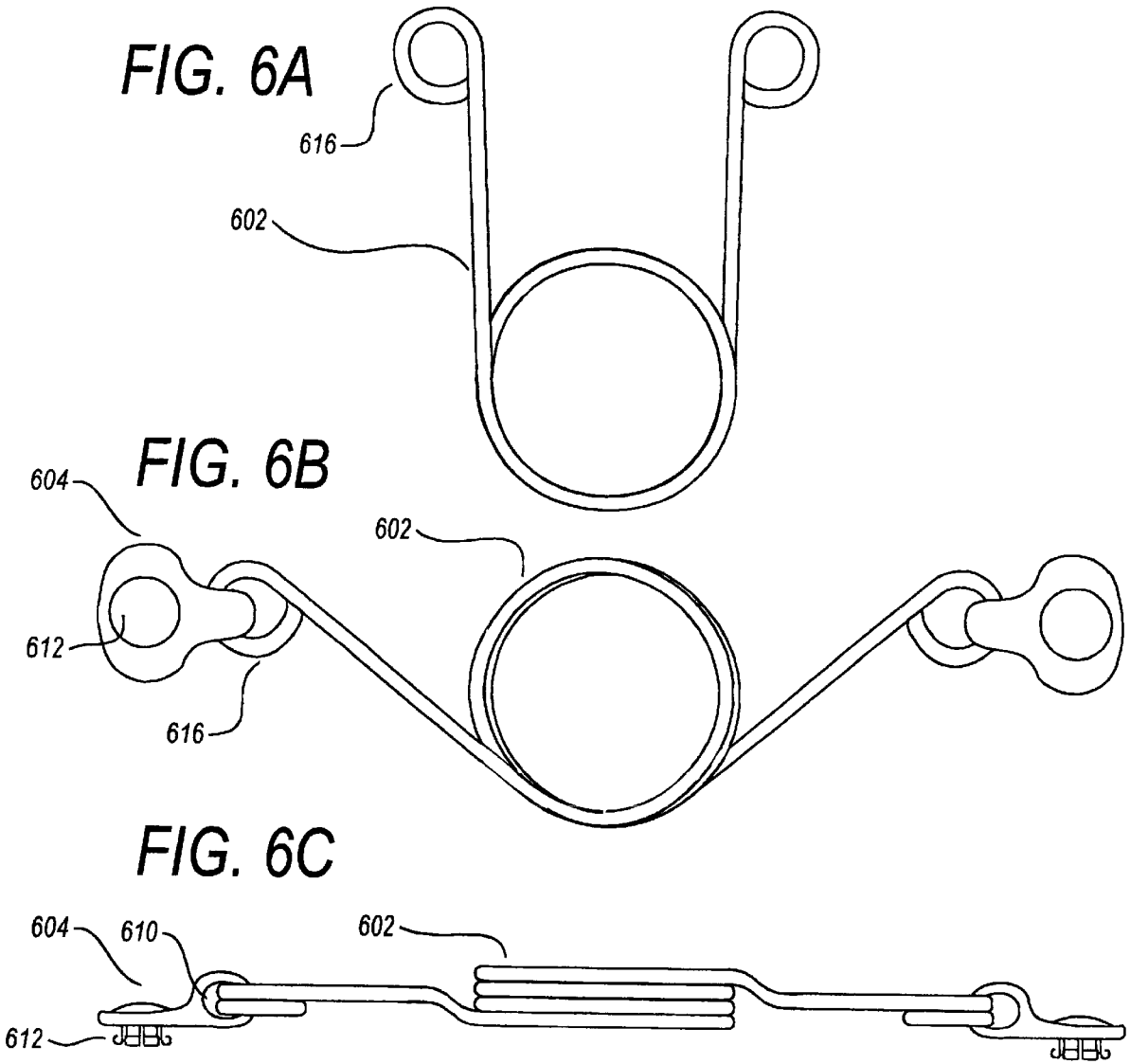
FIGS. 6A–6C depict a spring assembly comprised of a torsion type spring mechanism in accordance with exemplary embodiments of the present invention.

With regard to FIGS. 6A–6C, a spring assembly is depicted which comprises a torsion type spring mechanism in accordance with exemplary embodiments of the present invention. FIGS. 6A and 6B are top elevation views of torsion spring mechanism 602 in the relaxed and energized states, respectively. FIG. 6B depicts torsion spring mechanism 602 connected to a pair of locking eyelets 604 as would be expected on, for example, on footwear article 100 shown in FIG. 1. Because FIG. 6B depicts torsion spring mechanism 602 as being energized with tension, it is expected that footwear article 100 is being worn as represented in FIG. 6B. Here again locking eyelets 604 further comprise a main body with eyelet 610 near one extent and an aperture near the opposite extent (not shown), through which rivet 612 traverses for fastening locking eyelet 604 to an eye flap, for instance on footwear article 100 shown in FIG. 1.

The present torsion spring assembly differs from the aforementioned depicted spring assemblies in that the safety catch on spring attachment means 616 is formed by a spiral shaped configuration of the outer extent of the coils. This difference is necessary due the peculiar nature of torsion spring mechanism 602. In this case there is a modest danger that should a spring attachment means accidentally disconnect, then torsion spring mechanism 602 would become airborne. The coiled shape of spring attachment means 616 is better shown in FIG. 6C wherein torsion type spring mechanism 602 of the present invention is illustrated in a front elevation.

The description of the present invention has been presented for purposes of illustration and description but is not intended to be exhaustive or limited to the invention in the form disclosed. Many modifications and variations will be apparent to those of ordinary skill in the art. The embodiment was chosen and described in order to best explain the principles of the invention and the practical application, and to enable others of ordinary skill in the art to understand the invention for various embodiments with various modifications as are suited to the particular use contemplated.

What is claimed is:

1. A continual comfort adjusting system for a footwear article comprising:

a footwear article having a first portion and a second portion, wherein said first and second portions of said footwear article adjustably accept a wearer's foot;

a first fastener secured to said first portion of said footwear article, the first fastener comprising a body portion and an eyelet portion, the body portion coupling the fastener to the first portion;

a second fastener secured to said second portion of said footwear article, the second fastener comprising a body portion and an eyelet portion, the body portion coupling the second fastener to the second portion; and a spring assembly having a spring mechanism, a first spring connector at a first extremity of said spring assembly and a second spring connector at a second extremity of said spring assembly, said spring mechanism being interposed between said first spring connector and said second spring connector for providing tension between said first and second spring extremities of said spring assembly, said first spring connector being coupled to the eyelet portion of said first fastener and said second spring connector being coupled to the eyelet portion of said second fastener, whereby said spring assembly continual adjusts the comfort for the wearer's foot by providing tension between said first and second portions of said footwear article.

2. A continual comfort adjusting system recited in claim 1 further comprising:

a third fastener secured to said first portion of said footwear article;

a fourth fastener secured to said second portion of said footwear article; and a second spring assembly having a spring mechanism, a first spring connector at a first extremity of said second spring assembly and a second spring connector at a second extremity of said second spring assembly, said spring mechanism being interposed between said first spring connector and said second spring connector for providing tension between said first and second spring extremities of said second spring assembly, said first spring connector being coupled to said third fastener and said second spring connector being coupled to said fourth fastener, whereby said second spring assembly continual adjusts the comfort for the wearer's foot by providing tension between said first and second portions of said footwear article independent of the tension between said first and second portions of said footwear article provided by the spring assembly.

3. A continual comfort adjusting system recited in claim 1 further comprising:

a first plurality of fasteners secured to said first portion of said footwear article;

a second plurality of fasteners secured to said second portion of said footwear article; and a plurality of spring assemblies, each spring assembly of the plurality of spring assemblies having a spring mechanism, a first spring connector at a first extremity of said second spring assembly and a second spring connector at a second extremity of said second spring assembly, each of said spring mechanisms being interposed between respective said first spring connector and said second spring connector for providing tension between said first and second spring extremities of each respective spring assembly of the plurality of spring assemblies, each of said first spring connectors being coupled to a fastener in the first plurality of fasteners and each of said second spring connectors being coupled to a fastener in the second plurality of fasteners, whereby each spring assembly in the plurality of spring assemblies continual adjusts the comfort for the wearer's foot by providing tension between said first and second portions of said footwear article independent of the tension between said first and second portions of said footwear article provided by the spring assembly.

4. A continual comfort adjusting system recited in claim 3, wherein each spring assembly in the plurality of spring assemblies continual adjusts the comfort for the wearer's foot by providing tension between said first and second portions of said footwear article independent of each other spring assembly in the plurality of spring assemblies.

5. A continual comfort adjusting system recited in claim 1, wherein the spring mechanism is a compression-type mechanism.

6. A continual comfort adjusting system recited in claim 1, wherein the spring mechanism is a torsion-type mechanism.

7. A continual comfort adjusting system recited in claim 1, wherein the spring.

8. A continual comfort adjusting system recited in claim 7, wherein the eyelets of the first and second fasteners are first and second locking eyelets, respectively, which receive one of the first and second spring connectors at the respective extremities of said spring assembly, and said first and second locking eyelets are fastened to one of the first and second portions of said footwear article.

9. A continual comfort adjusting system recited in claim 8, wherein the first and second portions of said footwear article are eye flaps.

10. A continual comfort adjusting system recited in claim 9, wherein each of the first spring connector at a first extremity of said spring assembly and the second spring connector at a second extremity of said spring assembly further comprises:

a safety catch which substantially encircles the respective first and second locking eyelet.

11. A continual comfort adjusting tm recited in wherein claim 1, wherein each of the first spring connector at a first extremity of said spring assembly and the second spring connector at a second extremity of said spring assembly further comprises:

a safety catch which substantially encircles the respective first and second eyelets.

12. A continual comfort adjusting system recited in claim 2, wherein spring assembly further comprises:

a first predetermined distance separating the first extremity of said spring assembly is separated from said second extremity of said spring assembly; and the second spring assembly further comprises:

a second predetermined distance separating the first extremity of said second spring assembly is separated from said second extremity of said second spring assembly, wherein second predetermined distance is greater than said first predetermined distance.

13. A continual comfort adjusting system recited in claim 2, wherein at least one of said first and second predetermined distances are based on wearer comfort.

14. A continual comfort adjusting system recited in claim 1, wherein the footwear article is one of a low-quarter, mid-quarter, high-quarter, high-top and boot.

15. A continual comfort adjusting system for a footwear article comprising:

a first plurality of fasteners secured to a first portion of a footwear article, each of the first plurality of fasteners comprising a body portion and an eyelet portion, the body portion coupling each of the first plurality of fasteners to the first portion;

a second plurality of fasteners secured to a second portion of said footwear article, each of the second plurality of fasteners comprising a body portion and an eyelet portion, the body portion coupling each of the second plurality of fasteners to the second portion; and a plurality of spring assemblies, each spring assembly of the plurality of spring assemblies having a spring mechanism, a first spring connector at a first extremity of said second spring assembly and a second spring connector at a second extremity of said second spring assembly, each of said spring mechanisms being interposed between respective said first spring connector and said second spring connector for providing tension between said first and second spring extremities of each respective spring assembly of the plurality of spring assemblies, each of said first spring connectors being coupled to the eyelet portion of a fastener in the first plurality of fasteners and each of said second spring connectors being coupled to the eyelet portion of a fastener in the second plurality of fasteners, whereby each spring assembly in the plurality of spring assemblies continual adjusts the comfort for the wearer's foot by providing tension between said first and second portions of said footwear article independent of the tension between said first and second portions of said footwear article provided by the spring assembly.

16. A continual comfort adjusting system recited in claim 15 wherein each of the a first plurality of fasteners secured to the first portion of a footwear article and each of the second plurality of fasteners secured to the second portion of said footwear article are separated from an adjacent fastener secured to the respective portion of the footwear article by substantially equal distance.

17. A continual comfort adjusting system recited in claim 15 wherein the footwear article is one of a low-quarter, mid-quarter, high-quarter, high-top and boot.

18. A continual comfort adjusting system recited in claim 15, wherein an amount of tension between said first and second spring extremities of each respective spring assembly of the plurality of spring assemblies is determined on the basis of wearer comfort.

19. A continual comfort adjusting system recited in claim 15, wherein each spring assembly of the plurality of spring assemblies is one of metallically plated with a shiny metal, painted with a color matching the footwear article and painted with a color contrasting the footwear article.

* * * * *